US007775323B2

(12) United States Patent
Schweinberger

(10) Patent No.: US 7,775,323 B2
(45) Date of Patent: Aug. 17, 2010

(54) SILENCER WITH FIN OUTLET

(75) Inventor: Henning Schweinberger, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/846,939

(22) Filed: Aug. 29, 2007

(65) Prior Publication Data

US 2008/0164092 A1 Jul. 10, 2008

(30) Foreign Application Priority Data

Aug. 30, 2006 (DE) ..... 20 2006 013 280 U

(51) Int. Cl.
*F01N 13/18* (2010.01)

(52) U.S. Cl. ..... 181/282; 181/231; 181/283; 181/240; 181/269; 60/299; 60/302; 60/272; 60/308

(58) Field of Classification Search ..... 181/282, 181/231, 240, 269, 283; 60/299, 272, 302, 60/308

See application file for complete search history.

(56) References Cited

U.S. PATENT DOCUMENTS

RE14,469 E * 5/1918 Nordgren ..... 181/269
1,344,367 A * 6/1920 Wickersham ..... 181/231
1,775,511 A * 9/1930 Chapman ..... 181/240
2,838,129 A * 6/1958 Hesse et al. ..... 181/243
3,168,936 A * 2/1965 Gordon ..... 181/269
3,378,099 A * 4/1968 Gordon ..... 181/240
3,404,749 A * 10/1968 Miller et al. ..... 181/240
3,498,280 A * 3/1970 Zimmerer et al. ..... 123/555
3,650,354 A * 3/1972 Gordon ..... 181/240
3,665,712 A * 5/1972 Tenney ..... 60/314
3,798,769 A * 3/1974 Bailey ..... 30/383
3,884,655 A * 5/1975 Coop ..... 96/380
3,968,854 A * 7/1976 Gordon et al. ..... 181/269
4,142,607 A * 3/1979 Landwehr et al. ..... 181/259
4,231,221 A * 11/1980 Mathner et al. ..... 60/319
4,418,790 A * 12/1983 Agnew ..... 181/268
4,538,701 A * 9/1985 Lowery et al. ..... 181/274
4,592,445 A * 6/1986 Sawada ..... 181/229
4,846,301 A * 7/1989 Granath et al. ..... 181/230
4,854,417 A * 8/1989 Uesugi et al. ..... 181/272
4,867,270 A * 9/1989 Wissmann et al. ..... 181/231
5,109,949 A * 5/1992 Sato et al. ..... 181/240
5,139,107 A * 8/1992 Nagai ..... 181/240
5,183,977 A * 2/1993 Horitani ..... 181/266
5,206,467 A * 4/1993 Nagai et al. ..... 181/232

(Continued)

FOREIGN PATENT DOCUMENTS

DE 8812435.5 U1 12/1988

(Continued)

*Primary Examiner*—Jeffrey Donels
*Assistant Examiner*—Forrest M Phillips
(74) *Attorney, Agent, or Firm*—Kelly Lowry & Kelley, LLP

(57) ABSTRACT

A motor chain saw includes a housing with a housing wall, which has an opening for exhaust gases and a hood extending outside the housing through the opening, with a hood opening pointing to one side. Exhaust gases flowing from an interior of the housing in an exhaust jet (S) are guided to the outside through the opening. A fin is arranged on the opening and provides a silencer for exhaust gases directed towards a flow direction of the exhaust jet (S) escaping from the hood.

20 Claims, 5 Drawing Sheets

U.S. PATENT DOCUMENTS 5,315,075 A * 5/1994 Junginger et al. ..... 181/240
5,440,083 A * 8/1995 Masuda ..... 181/240
5,451,728 A * 9/1995 Chandler et al. ..... 181/230
5,521,339 A * 5/1996 Despain et al. ..... 181/230
5,651,249 A * 7/1997 Nagao et al. ..... 60/302
5,736,690 A * 4/1998 Karlsson ..... 181/230
5,738,184 A * 4/1998 Masuda et al. ..... 181/262
5,857,329 A * 1/1999 Bigham ..... 60/317
5,866,859 A * 2/1999 Karlsson et al. ..... 181/230
5,883,342 A * 3/1999 Wolpert ..... 181/230
5,959,262 A * 9/1999 Menzel ..... 181/231
5,996,732 A * 12/1999 Burger et al. ..... 181/230
6,041,890 A * 3/2000 Wolf et al. ..... 181/230
6,044,926 A * 4/2000 Yamane et al. ..... 181/230
6,076,632 A * 6/2000 Schuhmacher et al. ..... 181/282
6,109,026 A * 8/2000 Karlsson et al. ..... 60/302
6,164,066 A * 12/2000 Sakaguchi et al. ..... 60/302
6,170,604 B1 * 1/2001 Menzel et al. ..... 181/230
6,250,422 B1 * 6/2001 Goplen et al. ..... 181/272
6,341,662 B1 * 1/2002 Karlsson ..... 181/230
6,393,835 B1 * 5/2002 Stoll et al. ..... 60/299
6,422,338 B1 * 7/2002 Menzel et al. ..... 181/230
6,742,623 B2 * 6/2004 Tajima et al. ..... 181/269
6,910,550 B2 * 6/2005 Schlossarczyk et al. ..... 181/283
6,955,043 B2 * 10/2005 Schlossarczyk et al. ..... 60/299
6,978,605 B2 * 12/2005 Chiba et al. ..... 60/302
7,032,709 B2 * 4/2006 Hoche et al. ..... 181/268
7,156,202 B2 * 1/2007 Assad ..... 181/258
7,174,991 B1 * 2/2007 Gunnarsson et al. ..... 181/231
7,407,036 B2 * 8/2008 Kobayashi et al. ..... 181/240
2001/0037912 A1 * 11/2001 Menzel ..... 181/231
2003/0062216 A1 * 4/2003 Tajima et al. ..... 181/269
2003/0085072 A1 * 5/2003 Mukaida ..... 181/272
2003/0173148 A1 * 9/2003 Andersson et al. ..... 181/272
2004/0040783 A1 * 3/2004 Hoche et al. ..... 181/272
2004/0245044 A1 * 12/2004 Cerrato-Jay et al. ..... 181/268
2005/0029039 A1 * 2/2005 Maier ..... 181/268
2005/0051384 A1 * 3/2005 Breznik ..... 181/269
2005/0139418 A1 * 6/2005 Sieben et al. ..... 181/231
2005/0150716 A1 * 7/2005 Nasuno et al. ..... 181/231
2008/0164092 A1 * 7/2008 Schweinberger ..... 181/282

FOREIGN PATENT DOCUMENTS

JP 53122030 A * 10/1978
JP 05125935 A * 5/1993
WO WO0236942 A1 5/2002

* cited by examiner

SILENCER WITH FIN OUTLET

TECHNICAL FIELD

The invention relates to a silencer for a working tool, in particular a motor chain saw with a housing with a housing wall which has at least one opening for exhaust gases and a hood extending outside the housing through at least one opening, with a hood opening pointing to one side from which exhaust gases flowing from an interior of the housing are guided to the outside through the at least one opening in an exhaust gas jet.

STATE OF THE ART

Silencers are sufficiently known in the state of the art. Furthermore, exhaust gas outlets of the silencer in different forms are known.

An exhaust device for internal combustion engines is described in DE 25 39 516 A1. Here the silencer has three exhaust ports which comprise wall sections overlapping them and installed on the outside.

DE 28 22 966 C2 describes a hood-like outlet, also with walls projecting on the outside from the silencer.

DE 78 10 865 U1 describes an exhaust silencer for an exhaust device for internal combustion engines. It gives a description of a device similar to the aforementioned publication with outwardly projecting, inclined hoods.

The exhaust silencer should be designed so that during operation the formation of hot spots at contact points on the motor chain saw is prevented as it rolls off onto a roll-off surface. For the same reasons the heat of the exhaust gas jet on an envelope clamped through the contact points from exceeding a predetermined limit temperature.

The disadvantage of the silencers known in the state of the art is that the exhaust jet either bears against the outer silencer wall, heats and follows its contour, or can be directed sharply from the outer silencer in order to avoid the above disadvantage.

REPRESENTATION OF THE INVENTION

Object, Solution, Advantages

The object of this invention is to make available a silencer for a working tool which overcomes the advantages mentioned.

The object is achieved by a silencer with the features of claim 1.

The aforementioned silencer has a housing with a housing wall with at least one opening for exhaust gases and a hood extending outside the housing through the at least one opening, with a hood opening, pointing to one side, from which exhaust gases flowing from an interior of the housing are guided to the outside in an exhaust jet through the at least one opening. It has been shown that a fin arranged on the at least one opening and directed against the direction of flow of the exhaust jet predetermines, more precisely positions and focuses the exhaust jet escaping from the hood. This therefore prevents the exhaust jet from bearing against the housing wall on the outside.

For this purpose the at least one fin is preferably directed towards a hood roof, and it gives the exhaust gases escaping from the housing through the at least one opening a direction towards one inside of the hood roof. Directing the exhaust gas towards the inside of the hood roof provides the exhaust gas with a defined tear-off edge so that exhaust jet does not come into contact on the outside with the housing wall of the silencer.

The fin is arranged to oppose the direction of flow of the exhaust jet. The fin is preferably arranged at an angle to the hood roof so that exhaust gases are opposed to the direction of flow of the exhaust jet in at least one direction component after passing through the at least one opening. The angle is advantageously smaller than 90°, preferably smaller than 70°.

The advantage mentioned is particularly evident in a working tool in which the silencer according to the invention is installed and in which the hood opening must guide the exhaust jet along a housing wall of the silencer over the longest possible distance to an envelope formed by spacing surfaces. The envelope is formed by the spacing surfaces clamped through the contact points of the working tool—e.g. the chain saw without blade. The spacing surfaces therefore correspond to the shortest distance from the flat bottom, which can be ignited by the growth of moss, for example, to the working tool lying on it in a corresponding position.

The distance along the exhaust jet between the hood opening and the envelope is preferably the maximum distance. After escaping from the hood opening, the exhaust jet cools considerably as the distance increases. The cooling is of the order of 30° C./cm. The exhaust jet may be guided onto an extremely small region by the predetermination according to the invention. The exhaust temperature in the region must be kept as low as possible.

The silencer is normally mounted on a crankcase on a side of the internal combustion engine facing away from the user. Undesirable deflection of the exhaust jet by bearing against the crankcase is prevented by the silencer according to the invention, and additional heating of the housing wall of the silencer and adjacent components is avoided.

It has proved advantageous for each of the at least one fin to extend in the interior of the housing through exactly one opening. In principle, however, it is also conceivable to arrange at least one fin outside the housing and inside the hood through exactly one opening. The fin can even be guided through the opening.

The plane formed by the at least one fin opening is preferably arranged essentially perpendicularly to the housing wall. As a result of this arrangement the exhaust gas is forced particularly far into the region distant from the hood opening inside the hood. The exhaust jet may then bear particularly well against the hood roof on the inside and is able to escape from the hood in a focussed manner.

The at least one opening advantageously has a straight edge on one side and an arc-shaped edge on the opposite side. In this case the fin can be connected along the arc-shaped edge to the housing wall in a gas-tight manner. The straight edge of the opening, together with the open fin edge, forms the fin opening that is open on one side. The admission cross-section thus formed, which is essentially in the shape of a circle segment, has proved particularly favourable for focussing the exhaust jet.

In a particularly preferred further development of the silencer according to the invention a plurality of openings, arranged in a row pointing from one side to the opposite side, are provided in the housing wall. Here the shape of the openings is advantageously the same for each, and each of the openings is covered on the inside by exactly one fin. In particular, the fins may be of the same construction. The plurality of fins additionally focuses the exhaust jet and enlarges the admission cross-section.

The exhaust gas is largely prevented from bearing on the outside against the housing wall by a hood roof running obliquely to the housing wall and rising towards the hood opening opposite the housing wall if the exhaust jet bears on the inside against the hood roof. Preferably the hood roof is designed flat and is inclined at a slight angle of approximately 5 to 30 degrees to the housing wall. The hood roof forms a tear-off edge on the hood opening. The hood should, in the case of a plurality of openings, extend with its hood roof across all the openings.

A hood roof that widens towards the hood opening is also conceivable in order to disperse the exhaust jet in parallel with the housing wall.

The hood is advantageously formed in an essentially L-shaped cross-section that runs approximately centrally and perpendicularly through the hood opening from one side to the opposite side. The long L-leg then runs in the hood roof and the short L-leg runs in the hood wall Working tools, particularly hand-guided working tools such as motor chain saws, parting-off grinders and hedge shears, preferably have the silencer according to the invention. The silencer is then provided on the exhaust port of an internal combustion engine.

BRIEF DESCRIPTION OF THE DRAWINGS

The invention is described in seven figures with reference to an exemplary embodiment, in a purely diagrammatically representation.

FIG. 3 shows the representation according to FIG. 2, with the flow lines drawn in.

BEST WAY TO IMPLEMENT THE INVENTION

Figure 1:
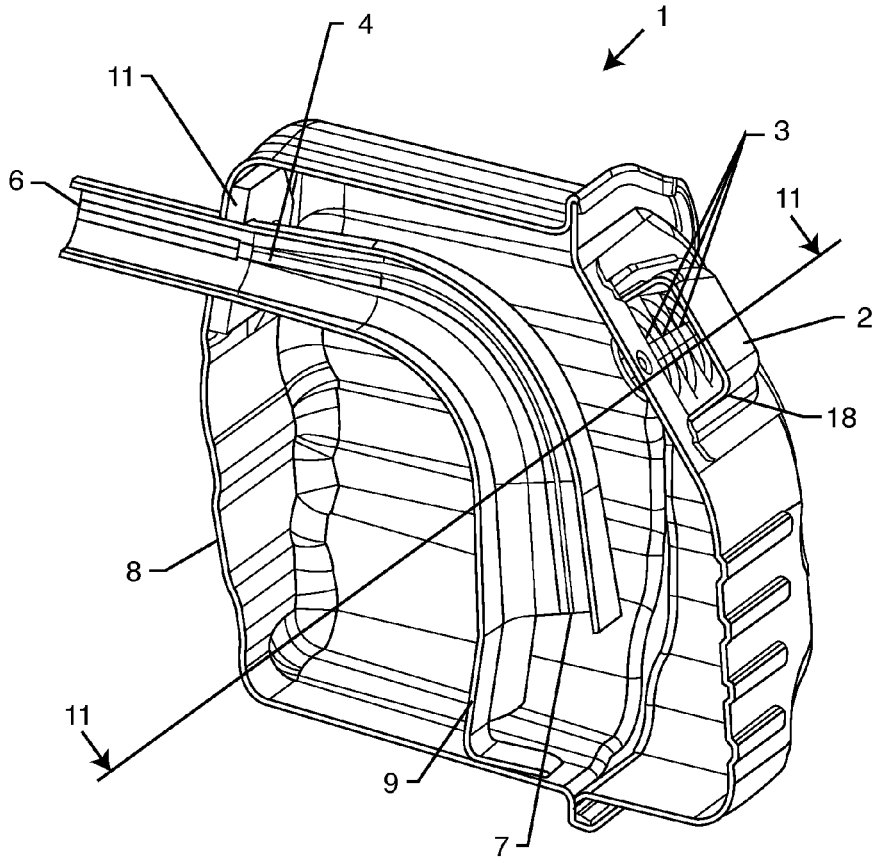
FIG. 1 shows a perspective sectional view of a silencer according to the invention.

FIG. 1 shows silencer 1 according to the invention with a hood 2 and three fins 3. The silencer shown has an exhaust inlet 6. Exhaust inlet 6 of silencer 1 is connected to the exhaust port of an internal combustion engine (not drawn). Silencer 1 and the internal combustion engine are arranged as components of the drive unit in a working tool, in particular a hand-guided working tool such as a chain saw. Because of deflections of the exhaust jet affecting its housing design in particular, silencer 1 has noise damping properties. The exhaust gases fed into silencer 1 are conducted by means of the three fins 3 to three openings 16, which flow through them and which then reach the interior of hood 2, whence they are discharged into the environment through hood opening 13.

Figure 2:
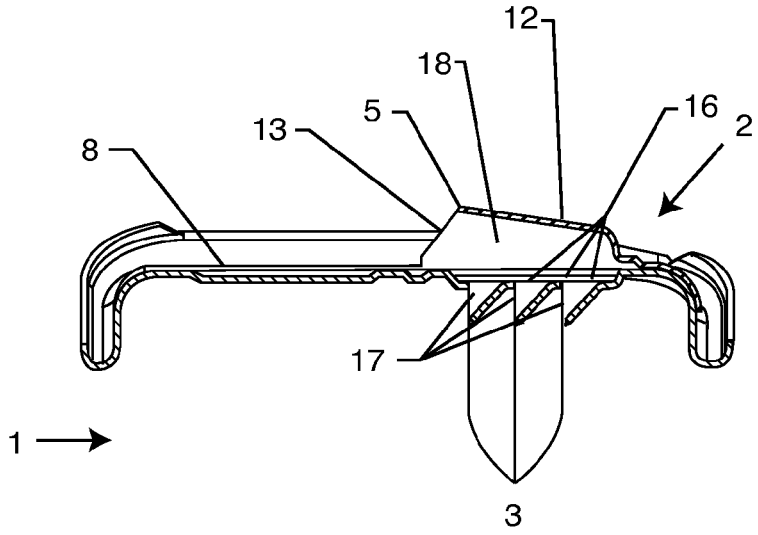
FIG. 2 shows a sectional view along line II-II in FIG. 1.

FIG. 2 shows the sectional representation along line II-II in FIG. 1. Silencer 1 has a box-shaped housing. The three fins 3 are provided on housing wall 8 opposing exhaust inlet 6. Hood 2, opposing the three fins 3 on the outside of housing wall 8, is open on one side, against the direction of displacement. Hood wall 18 surrounds three quarters of hood 2 and forms a gas-tight connection to housing wall 8 and hood roof 12. Hood roof 12 runs obliquely to housing wall 8, and it is designed so that it rises towards hood opening 13, opposite housing wall 8. A free edge of the hood roof forms the edge of hood opening 13 facing the housing, and it acts as tear-off edge 5 for the exhaust jet escaping from hood 2.

The three fins 3, unlike hood 2, are provided on the inside of the silencer housing but are open on the same side as hood 2. Each of the three fins 3 opens into an opening 16 in housing wall 8. Each fin 3 is arranged completely straight along the section running centrally from one side to the opposite side perpendicularly to housing wall 8, and is inclined at an angle of approximately 45°, so that it projects on the inside from silencer wall 8. Each of fins 3 forms a fin opening 17 pointing to one side on the inside.

Hood 2 is designed to have an essentially L-shaped cross-section according to FIG. 2. Lateral hood walls 18 project on the outside essentially perpendicularly from housing wall 8 and pass smoothly into hood roof 12.

Figure 3:
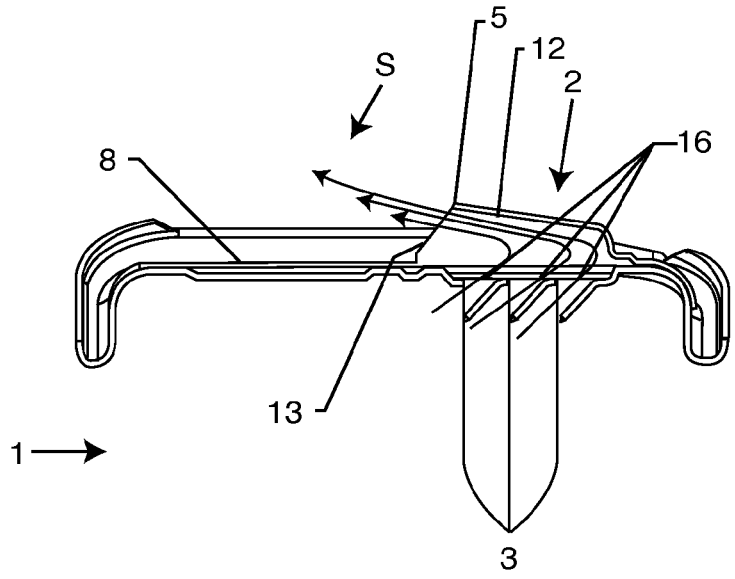

FIG. 3 shows the lines of exhaust jet S from silencer 1. Exhaust gases are conducted continuously through exhaust manifold 4 in FIG. 1 and into silencer 1, which gases flow through the three openings 16 because of the excess pressure forming there. The exhaust gas flowing from the housing is caused to flow through fins 3 towards the opposite side, the right side in the drawing, and initially retains this direction of flow even after passing through the three openings 16. The exhaust gas is therefore forced into the closed interior of hood 2 opposing hood opening 13. From there the exhaust gas flows on the inside to hood opening 13, bearing against hood roof 12, and is deflected by approximately 120°. Exhaust jet S tears off on tear-off edge 5. Exhaust S is narrowly focussed, i.e. it is directed on tear-off edge 5 perpendicularly to housing wall 8. On the one hand, therefore, the gases no longer flow so that they bear against and along housing wall 8. On the other hand the positioned exhaust jet S can easily be handled because it can be aligned exactly in a desired direction.

Figure 4:
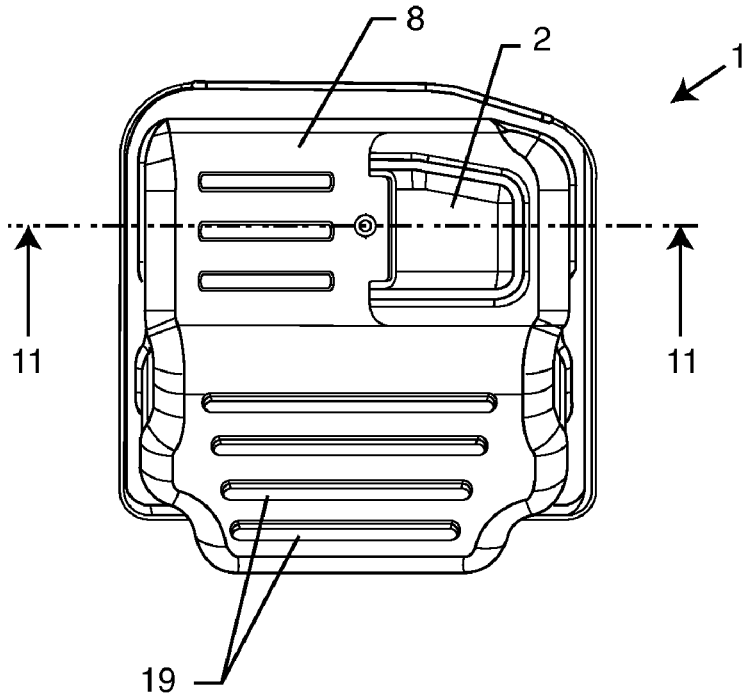
FIG. 4 shows a front view of the silencer in FIG. 1.

FIG. 4 shows housing wall 8 of the silencer facing away from the exhaust inlet in a front view, i.e. from the outside. Silencer 1 has a plurality of stabilising horizontal bulges 19. Hood 2 is formed integrally from a steel sheet and is placed over the three openings 16 in the shape of a roof. Hood 2 is arranged so that it is laterally displaced from the central axis of silencer 1. The sectional view in FIG. 2 is represented by line II-II in FIG. 4.

Figure 5:
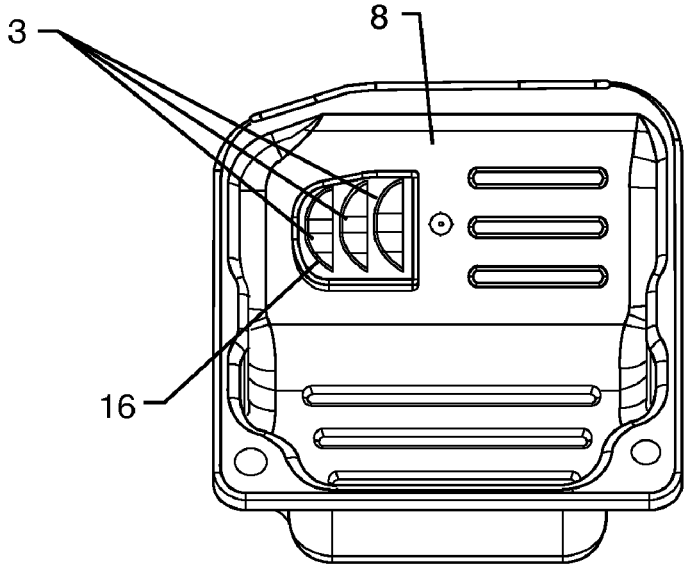
FIG. 5 shows a rear view of the silencer wall in FIG. 4.

FIG. 5 shows housing wall 8 in FIG. 4 in a rear view. This view corresponds in FIG. 1 to a view from silencer 1 from the inside towards housing wall 8. FIG. 5 shows, in particular, the design of the three fins 3. Each fin 3 overlaps an opening 16, with a straight edge along one side and with a curved edge along the opposite side. The straight edge seals perpendicularly against a free edge of fin 3. Fin 3 forms a lateral fin opening 17 pointing to one side.

Figure 6:
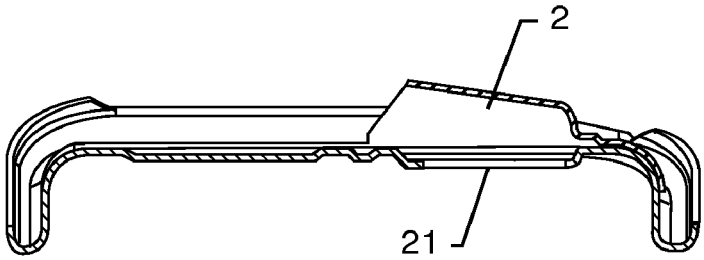
FIG. 6 shows a sectional view of a silencer according to the state of the art corresponding to FIG. 2.
Figure 7:
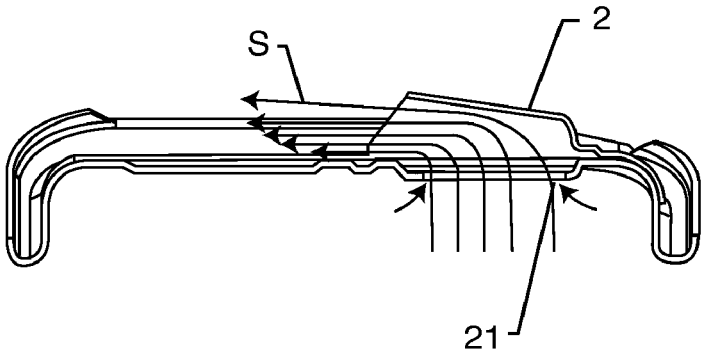
FIG. 7 shows a representation according to FIG. 6, with flow lines.

FIGS. 6 and 7 show a section corresponding to FIG. 2, but through a hood 2 of prior art. Hood 2 has a single opening 21. The one opening 21 is covered by hood 2. The flow pattern shown in FIG. 7 deviates from the flow pattern according to FIG. 3. The escaping exhaust jet S in FIG. 7 runs essentially parallel with the housing wall and bears against it. Because exhaust jet S bears against the wall, surrounding components are heated undesirably. Silencer housing 8 is therefore subjected during operation to a constant high thermal load due to the hot exhaust gases.

Figure 8:
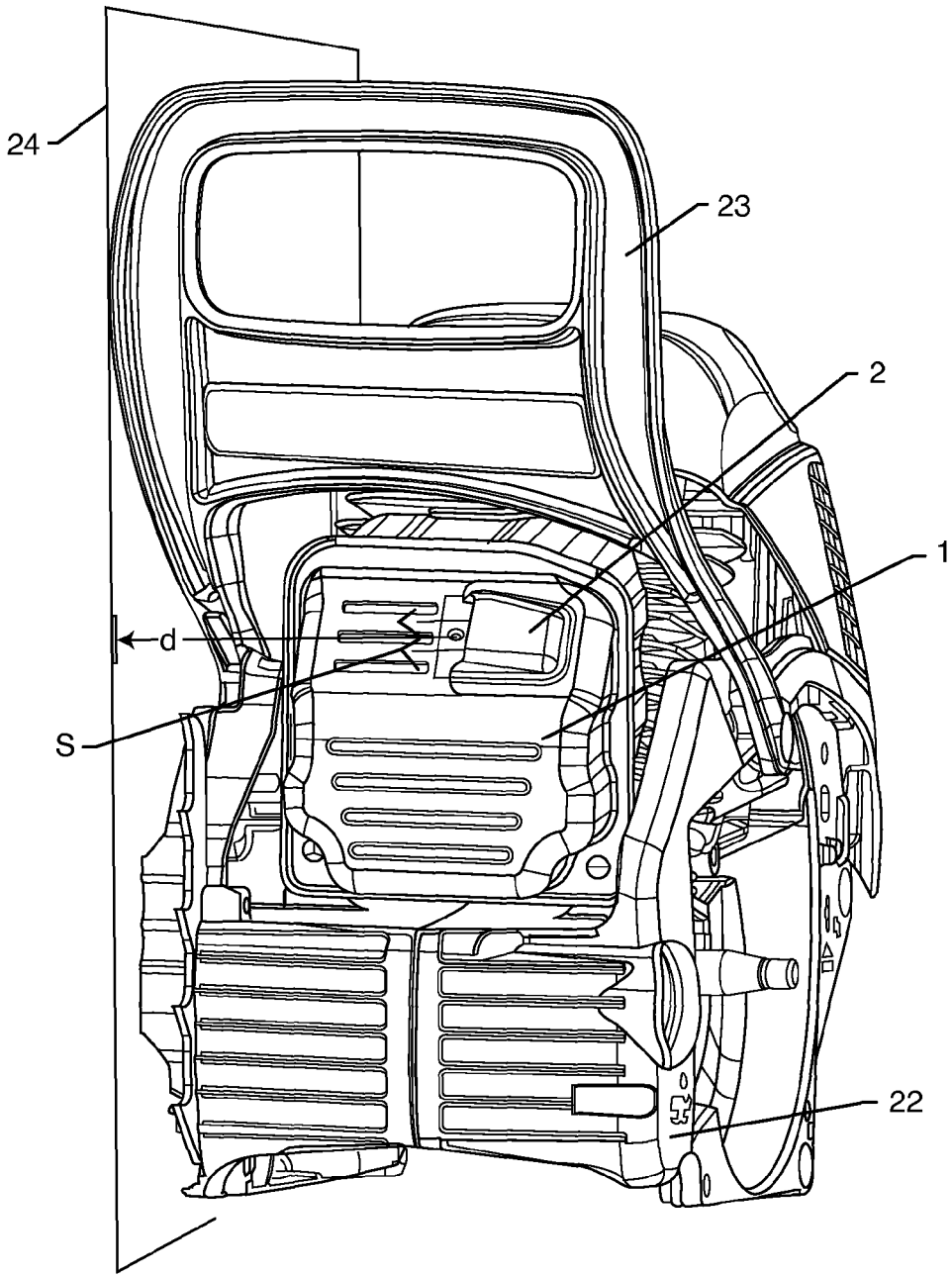
FIG. 8 shows a perspective view of a silencer installed in a chain saw.

FIG. 8 shows silencer 1 mounted on a crankcase 22. Exhaust jet S, positioned by silencer 1 according to the invention, is directed in a defined manner towards front handle 23 and crankcase 22. The points of contact of the chain saw without a blade, determined by the San Dimas test, with a flat roll-off surface, determine spacing surfaces 24 generally clamped through three points. Spacing surfaces 24 completely surround the chain saw in the form of an envelope.

Silencer 1 is installed in the chain saw so that exhaust jet S is separated by the maximum distance d from a spacing surface 24 after escaping from hood 2. According to experience the exhaust gas cools by approximately 30° C. per centimeter. Hood 2 is installed on silencer 1 and silencer 1 is installed in the chain saw in such a manner that the temperature of the exhaust gas on spacing surface 24 is as low as possible. The positioning of exhaust jet S according to the invention makes it possible to direct exhaust jet S very specifically to a point on spacing surfaces 24 that is as far away as possible.

The invention claimed is:

1. A silencer for a working tool comprising:

A housing with a housing wall, which has at least one opening for exhaust gases;

A hood extending outside the housing surrounding the at least one opening, having a hood roof with a hood opening pointing to one side, from which opening exhaust gases flowing from an inside of the housing are guided outwards in an exhaust jet through the at least one opening; and At least one fin arranged at an angle to the hood roof inside of the housing in the at least one opening and at least one fin opening associated with the at least one fin, characterized in that the angle between the hood roof and each of the at least one fin is less than 90°, wherein each of the at least one fin opening is pointed to the same side as the hood opening and none of the at least one fin opening is pointed to the opposite side as the hood opening, such that flow through the fin opening is directed toward the hood roof in such a manner that the exhaust gases are conducted at least partially against the direction of flow of the exhaust jet escaping from the hood opening.

2. The silencer according to claim 1, characterized in that the angle is less than 70°.

3. The silencer according to claim 1, characterised in that each of the at least one fin is arranged on the edge of exactly one opening.

4. The silencer according to claim 1, characterised in that the at least one opening has on one side a straight edge and on the opposite side an arc-shaped edge.

5. The silencer according to claim 4, characterised in that the at least one fin is connected along the arc-shaped edge of the at least one opening to the housing wall, and in that the straight edge of the opening, together with an open fin edge, forms the fin opening.

6. The silencer according to claim 5, characterised in that a plane formed through the fin opening is arranged essentially perpendicularly to the housing wall.

7. The silencer according to claim 1, characterised in that a plurality of openings arranged in a row are provided in the housing wall.

8. The silencer according to claim 7, characterised in that the shape of each of the plurality of openings is the same and in that the plurality of openings are arranged so that they are evenly spaced relative to each other.

9. The silencer according to claim 8, characterised in that each fin in each of the plurality of openings has the same construction.

10. The silencer according to claim 1, characterised in that an edge of the hood roof bordering the hood opening is designed as a tear-off edge.

11. The silencer according to claim 10, characterised in that the hood roof runs so that it rises towards the hood opening relative to the housing wall.

12. The silencer according to claim 11, characterised in that the hood roof widens towards the hood opening.

13. The silencer according to claim 10, characterised in that the hood roof is connected to the housing wall by a hood wall surrounding approximately three quarters of the at least one opening.

14. The silencer according to claim 13, characterised in that the hood is formed in an essentially L-shaped cross-section running approximately centrally and perpendicularly through the hood opening from one side to the opposite side, and in that the long L-leg runs in the hood roof and the short L-leg runs in the hood wall.

15. A working tool with a silencer according to claim 1, characterised in that the hood opening has a maximum distance (d) from an envelope of the working tool formed by spacing surfaces, on whose corners are arranged points of contact of the working tool with a roll-off surface.

16. The working tool according to claim 15, characterised in that it is a motor chain saw.

17. A silencer for a working tool comprising:

A housing with a housing wall, which has at least one opening for exhaust gases; a hood extending outside the housing surrounding the at least one opening, having a hood roof with a hood opening pointing to one side, from which opening exhaust gases flowing from an inside of the housing are guided outwards in an exhaust jet through the at least one opening, where the hood is formed in an essentially L-shaped cross-section running approximately centrally and perpendicularly through the hood opening from one side to the opposite side, and in that the long L-leg runs in the hood roof and the short L-leg runs in the hood wall; and a plurality of fins arranged at an angle to the hood roof, characterized in that the angle is less than 90° on the inside of the housing in the at least one opening, wherein each of the plurality of fins has a fin opening pointing to the same side as the hood opening and none of the fin openings are pointing to the opposite side as the hood opening, such that flow through the fin openings is directed toward the hood roof in such a manner that the exhaust gases are conducted at least partially against the direction of flow of the exhaust jet escaping from the hood opening, where a plane formed through each of the fin openings is arranged essentially perpendicularly to the housing wall.

18. The silencer according to claim 17, characterised in that the angle between the hood roof and each of the plurality of fins is less than 70°.

19. The silencer according to claim 17, characterised in that each of the plurality of fins is connected along an arc-shaped edge in the at least one opening and an opposing straight edge together with each fin forms the fin openings.

20. The silencer according to at claim 17, characterised in that an edge of the hood roof bordering the hood opening is designed as a tear-off edge and that the hood roof is connected to the housing wall by a hood wall surrounding approximately three quarters of the at least one opening.

* * * * *